US005342041A

United States Patent [19]

Agulnek et al.

[11] Patent Number: 5,342,041

[45] Date of Patent: Aug. 30, 1994

[54] GUIDING SYSTEM FOR ATHLETES

[76] Inventors: Aaron Agulnek; Martin Agulnek, both of 107 Brook Rd., Sharon, Mass. 02067

[21] Appl. No.: 14,404

[22] Filed: Feb. 5, 1993

[51] Int. Cl.[5] ..... A63B 69/00

[52] U.S. Cl. ..... 273/1.5 A; 364/516

[58] Field of Search ..... 273/1.5 A, 57.2, 2, 273/14, 54 D, 411; 364/410, 411, 516

[56] References Cited

U.S. PATENT DOCUMENTS 4,882,676 11/1989 Van De Kop et al. ..... 273/14 X

OTHER PUBLICATIONS

Invent America Official 1992 Student Entry Form.

*Primary Examiner*—Paul E. Shapiro

*Attorney, Agent, or Firm*—Wolf, Greenfield & Sacks

[57] ABSTRACT

An apparatus is provided for assisting players during practices or games in games, such as basketball, in which a ball or other object is directed toward a desired location. A video camera detects the ball and provides a signal indicating the location of the ball. A processor uses the location to determine an optimal location to direct the ball, and provides a signal to an illumination system. The illumination system provides a visual indication of where the player should direct the ball. The apparatus should be able to accommodate a game in which a ball may move quickly.

14 Claims, 4 Drawing Sheets

GUIDING SYSTEM FOR ATHLETES

BACKGROUND OF THE INVENTION

This invention relates to a system for assisting athletes in games in which a ball manually is directed to a desired location.

Basketball, for example, is a very popular spectator and participant sport. A player shoots a basketball through a hoop which is positioned ten feet above the floor and is mounted to a relatively large wood, glass, fiberglass, or metal backboard. Generally, players try to score in one of two ways, either by throwing the ball directly through the hoop, or by throwing the ball off the backboard to ricochet into the hoop. Generally, a successful shot can be made in different ways, although in some cases, one kind of shot is considered better than others. The best way to make a shot generally depends on where the player and ball are located on the court.

Many other games involve directing an object at a desired location, such as hockey, billiards, soccer, and bowling. In some of these games also, there are different options for how to direct the ball, puck, or other object. It would be useful to have a system which provides a visual aid to players for indicating the best shot at any moment, especially during practice or training, and particularly when there are a number of different shots a player could select.

SUMMARY OF THE INVENTION

The invention features a method and apparatus for helping athletes direct a shot in a game such as basketball. The apparatus comprises a video camera system which detects the position of the ball and provides a signal to circuitry which receives the signal, determines on the basis of the ball's position a desired location where a player should direct the ball, and provides an output signal. An illumination system receives the output signal from the circuitry and provides a visual indication to the player of the desired location where the player should direct the ball, based on the received output signal.

The ball can be detected in one of a several ways. The ball can have a pattern or color on it, and the camera can have a filter which passes the spectrum which the ball emits. Otherwise, the ball can be detected by scanning an area with a grid overlay, and determining the location relative to grid lines; or by scanning and storing data in memory where the memory locations each correspond to positions in the scanning area. Alternatively, pattern recognition techniques may be employed as part of, or in conjuction with, the camera system. When the processor receives a signal indicating the position of the ball, the processor determines where the ball should be directed, based on the position of the ball, to make the best shot. The best shot can be determined with calculations or with a lookup table.

The illumination system receives a signal from the processor and provides a visual target indication to the user, based on the signal. The visual indication can be provided by a system including a light source, an array of lenses, and a corresponding array of electro-optical shutters, such as liquid crystals or plzt shutters. One shutter opens at a time to allow light to be directed toward the desired location. Alternatively, a motor can be used to move a light source, such as a laser beam, or to move the beam without moving the source.

The invention also features a method for assisting players who are playing a game with an object, such as a ball, on a field of play, such as a basketball court. The method comprises the steps of detecting the position of the object, determining a location to which the player should direct the object to score points, based on the position of the object, and causing an illumination source to provide a visual indication of the determined location.

The invention provides assistance to athletes, particularly while training or practicing. It can be used with relatively slow games in which objects move at a slow pace, or in games in which a ball is frequently moving, such as basketball.

Other features and advantages will be apparent from the following description of preferred embodiments and from the claims.

DESCRIPTION OF THE PREFERRED EMBODIMENTS

Figure 1:
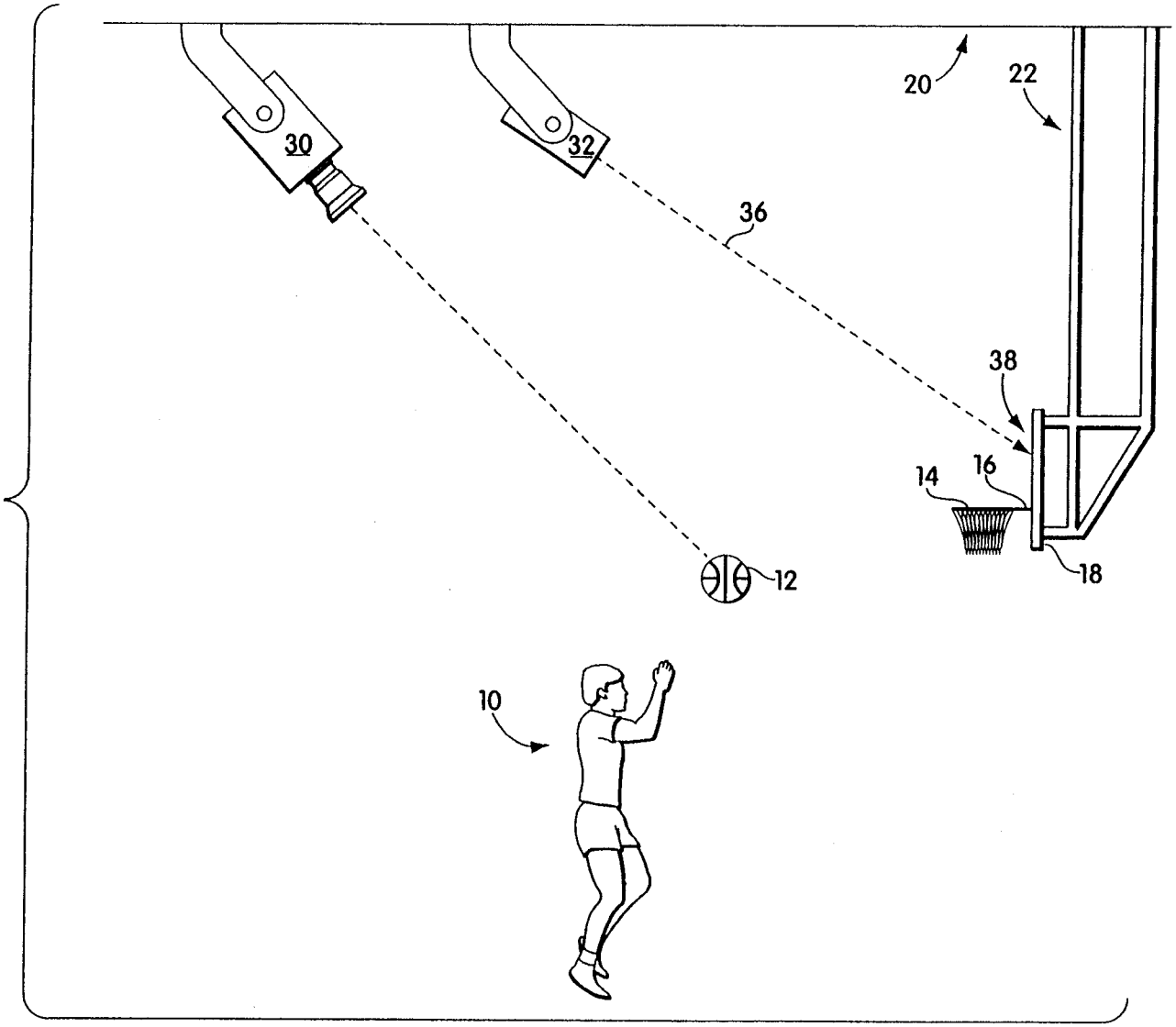
FIG. 1 is a side view of an embodiment of the present invention.

Referring to FIG. 1, a player 10 shoots a basketball 12 at a hoop 14. The hoop 14 is mounted with a bracket 16 to a backboard 18, which is suspended from a ceiling 20 with pipes and/or cables 22. Also suspended from the ceiling 20 are a video camera 30 and an illumination system 32. The video camera 30 images half of the basketball court onto a grid (FIG. 2), detects the position of the ball 12, and provides information relating the position to a processor (not shown). The processor uses this information and controls the illumination system 32 to project a beam 36 onto a location 38 on the backboard 18 to illuminate a spot. The illuminated spot provides an indication to the player 10 of where to shoot the ball 12.

The ball can be colored or have a design so that the spectral emission peaks at some frequency, such as in the infrared range. A notched spectral filter 34 is positioned over the camera lens to filter the image, particularly to filter out the background. The ball then appears as a bright spot against the background field.

Figure 2:
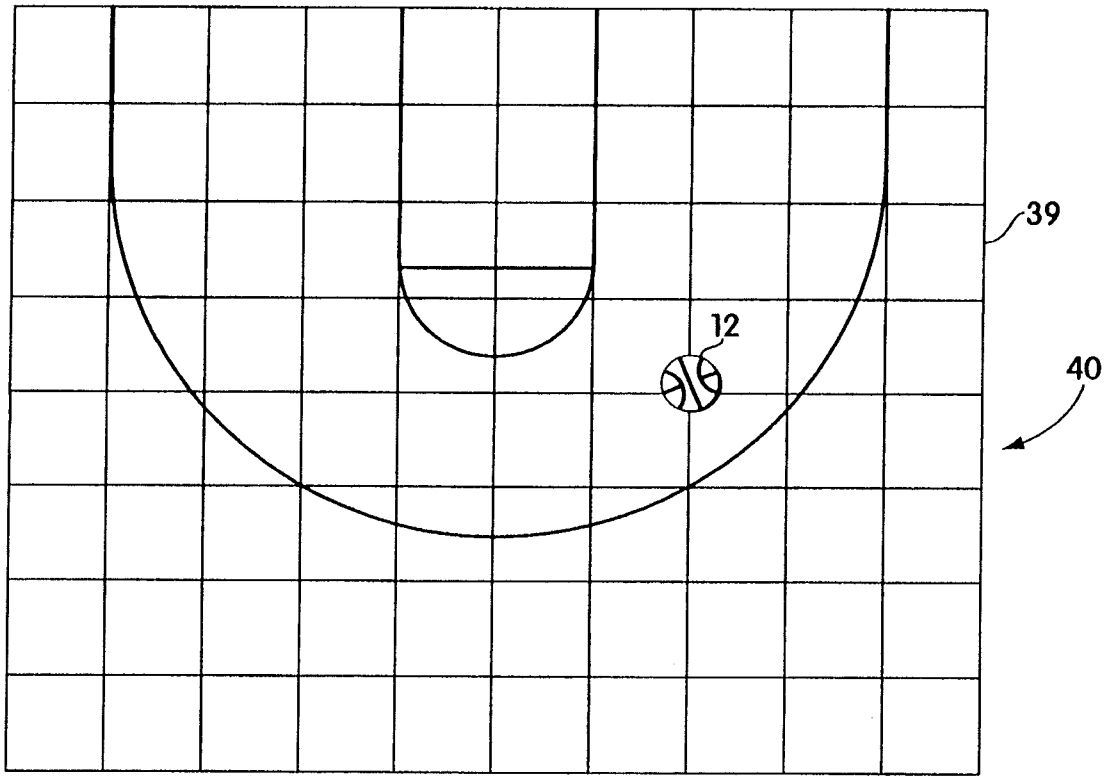
FIG. 2 is a representation of an image viewed by a video camera.

The ball might instead emit some other spectrum with a filter. The ball can be located relative to the court by collecting data row-by-row and storing it in the memory so that its location in memory corresponds to a location on the court. This is a detecting method generally known in the art. Referring to FIG. 2, the video camera 30 can instead image a basketball court 39 onto a grid 40 with an overlay which is framed onto the lens. To help detect the ball 12, and to help distinguish it from other objects, such as a player's head, the ball may be specially marked with a pattern, such as spots or crosses. The position of the ball is determined relative to the grid lines. With a filter, it is more likely that a sufficient peak will be detected to identify the ball.

Figure 3:
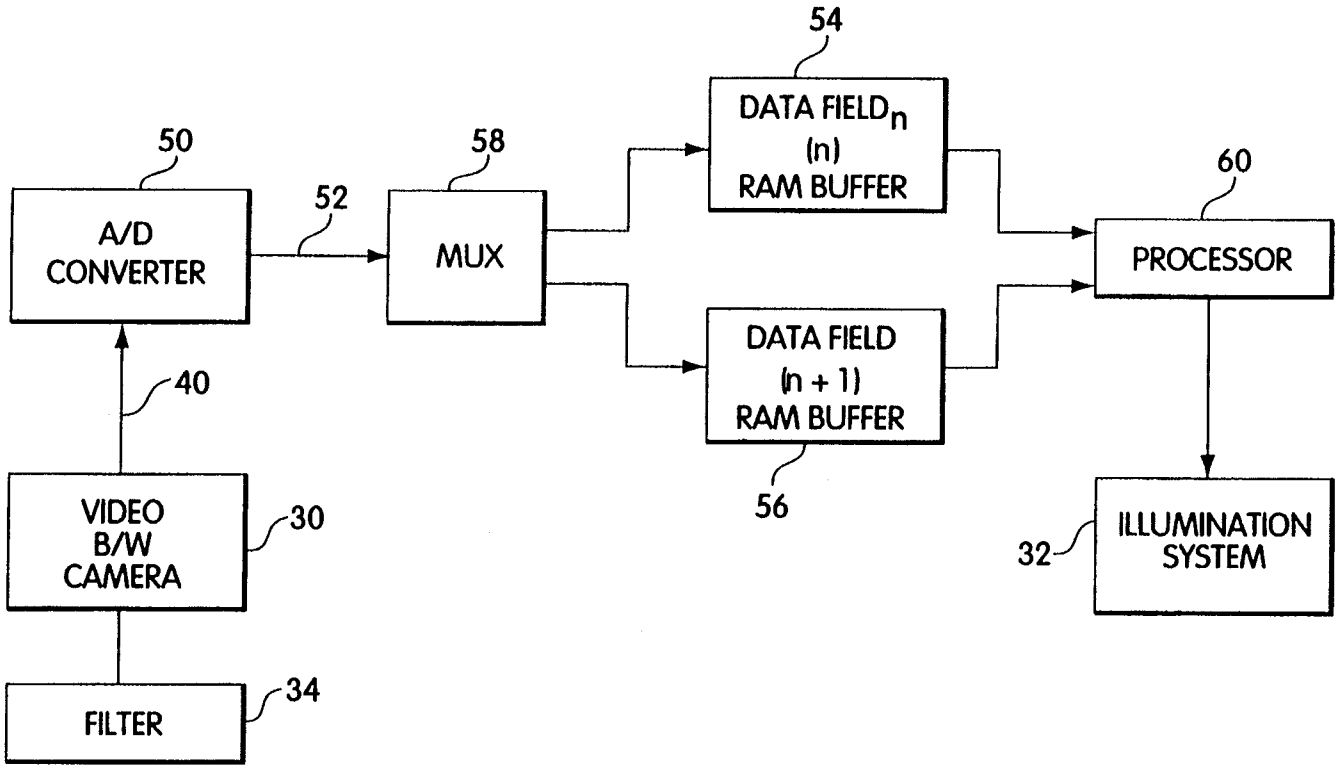
FIG. 3 is a block diagram of an embodiment of the present invention.

Referring to FIG. 3, a video image 40 is sent by the video camera 30 to an analog-to-digital converter 50 which digitizes the signal. A digitized signal 52 is coupled to a multiplexer 58 which selects one of two alternating RAM buffers 54, 56. Every 16.6 msec, or at some other selected rate, a digitized signal is provided to one of the buffers 54, 56. For some games, such as basketball, the ball may be frequently moving, so it is important that the information can be updated frequently enough to keep pace with the game or practice session.

A processor 60 processes the data in one buffer while the other buffer is being loaded. The processor 60 can either perform calculations or use a lookup table to determine a desired location where the player should shoot the ball. The processor then provides a signal which directs the illumination system 32 to provide a beam of light in accordance with the determined location.

Figure 4:
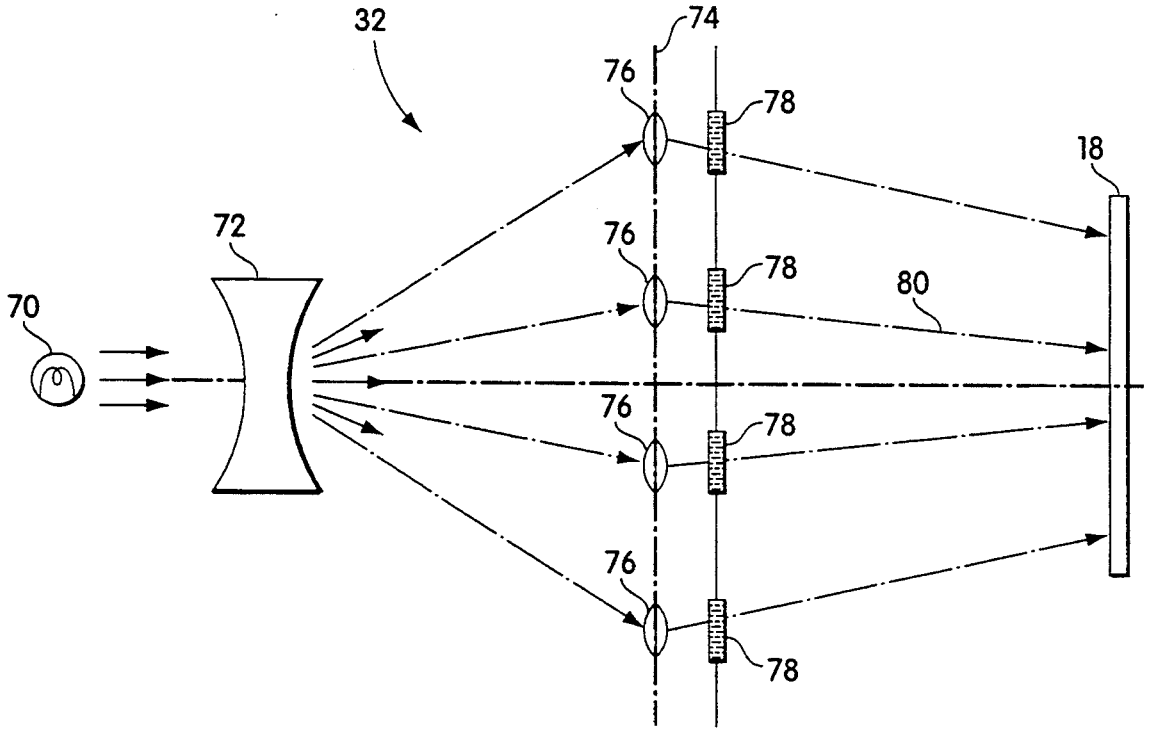
FIG. 4 is a pictorial representation of an illumination system according to the present invention.

Referring to FIG. 4, a light source 70, such as a bright light bulb, provides light to a lens 72 which disperses the light to a plane 74 of focusing lenses 76. The lenses 76 are arranged in a two-dimensional array, and each is provided with a corresponding electro-optic shutter 78, such as a liquid crystal or a plzt shutter. A plzt shutter includes lanthanum modified lead zirconate titaniate. It allows light to pass when energized by an electrical signal, since the polarity changes as a function of the electric field. The processor 60 (FIG. 3) directs an appropriate shutter to energize and a previously open shutter to de-energize, causing a beam of light to illuminate a visible spot. The shutters should be quick enough to accommodate the change in position of the moving ball.

Figure 5:
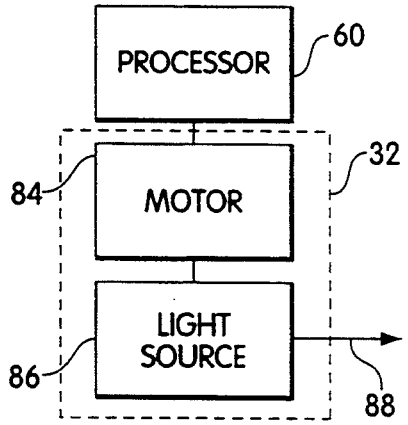
FIG. 5 a block diagram of a processor and an alternative illumination system according to the present invention.

Alternatively, referring to FIG. 5, the processor 60 can provide a signal to a motor 84 which adjusts the position of a light source 86, such as a laser, to direct the light beam 88 to a desired location on the backboard. The motor could adjust the source itself, or other optical elements which direct the light beam while the laser is stationary.

Having thus described a few particular embodiments of the invention, various alterations, modifications and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. An apparatus for use by ball players who are engaged in an exercise of directing a ball at a desired location comprising:

a video camera which detects a position of the ball and provides a signal responsive thereto;

circuitry which receives the signal from the video camera, determines a target location indicating where a player should direct the ball to cause the ball to arrive at the desired location, based on the position of the ball, and provides an output signal; and an illumination system which receives the output signal from the circuitry and provides to the player a visual indication of the target location where the player should direct the ball, based on the received output signal, wherein the ball, upon illumination, emits a particular spectrum, the apparatus further comprising a filter to filter an image received from the video camera, said filter for enhancing the spectrum emitted by the ball.

2. The apparatus of claim 1 wherein the circuitry comprises an analog to digital converter for converting an analog signal from the video camera to a digital signal, and a processor for using the digital signal to determine the target location.

3. The apparatus of claim 1 wherein the circuitry includes a memory which receives data from the video camera, said memory having a plurality of locations, each of which corresponds to a physical location on a field of play where the ball is used.

4. The apparatus of claim 1 wherein the illumination system includes a light source which produces a beam and a motor which moves the light beam in response to the output signal.

5. The apparatus of claim 1 wherein the circuitry has means for receiving and processing input signals and for providing output signals at a sufficient rate so that the illumination system can provide a series of visual indications as the ball is moving.

6. The apparatus of claim 1 wherein the illumination system provides a visual indication automatically without user input.

7. An apparatus for use by ball players who are engaged in an exercise of directing a ball at a desired location comprising:

a video camera which detects a position of the ball and provides a signal responsive thereto;

circuitry which receives the signal from the video camera, determines a target location indicating where a player should direct the ball to cause the ball to arrive at the desired location, based on the position of the ball, and provides an output signal; and an illumination system which receives the output signal from the circuitry and provides to the player a visual indication of the target location where direct the ball, based on the received output signal, wherein the illumination system comprises:

a light source;

an array of lenses; and an array of shutters corresponding to the array of lenses; and means for actuating each shutter in the array of shutters.

8. The apparatus of claim 7 wherein the shutters are electro-optical shutters.

9. The apparatus of claim 7 wherein one shutter is open at a time in response to the output signal.

10. The apparatus of claim 9 wherein the ball has a design to emit a selected frequency, the apparatus further comprising a filter for filtering out most frequencies other than the selected frequency and wherein the circuitry includes an analog-to-digital converter, at least one buffer, and a processor for providing the output signal.

11. An apparatus for use with a game in which a player directs an object toward a desired location, the apparatus comprising:

means for providing a signal representing a position of the object;

means for determining, based on the signal, a target location where the player should direct the object; and means for providing a visual indication of the target location where the player should direct the object, wherein the means for determining and the means for providing a visual indication operate automatically without user input, wherein the means for determining includes means for updating the target location frequently as the object is moving.

12. The apparatus of claim 11 wherein the means for providing a signal includes a video camera.

13. An apparatus for use with a game, in which a player directs an object toward a desired location comprising:

means for providing a signal representing a position of the object;

means for determining, based on the signal, a target location where the player should direct the object; and means for providing a visual indication of the target location where the player should direct the object, wherein the means for providing a visual indication includes a light source and an array of shutters, said output signal directing the means for providing a visual indication to energize a selected shutter.

14. An apparatus for use by ball players who are engaged in an exercise of directing a ball at a desired location, the apparatus comprising:

a video camera which detects a position of the ball and provides a signal responsive thereto;

circuitry which receives the signal from the video camera, determines a target location indicating where a player should direct the ball to cause the ball to arrive at the desired location, based on the position of the ball, and provides an output signal; and an illumination system which receives the output signal from the circuitry and provides to the player a visual indication of the target location where the player should direct the ball, based on the received output signal, wherein the circuitry includes a processor and at least one buffer, the processor for determining the target location and for providing the output signal frequently as the target is moving, and wherein the illuminating system includes means for receiving the output signal, and means for changing the position of the visual indication frequently as the target is moving.

* * * * *